US011847984B2

(12) United States Patent
Lakshminarayanan et al.

(10) Patent No.: US 11,847,984 B2
(45) Date of Patent: Dec. 19, 2023

(54) METHODS AND APPARATUS FOR A SELF-CALIBRATING AND ADAPTIVE DISPLAY

(71) Applicant: Texas Instruments Incorporated, Dallas, TX (US)

(72) Inventors: Aravind Lakshminarayanan, Frisco, TX (US); Jeffrey Kempf, Dallas, TX (US); Paul Rancuret, McKinney, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 17/828,825

(22) Filed: May 31, 2022

(65) Prior Publication Data

US 2023/0186864 A1 Jun. 15, 2023

Related U.S. Application Data

(60) Provisional application No. 63/288,052, filed on Dec. 10, 2021.

(51) Int. Cl.
*G09G 3/00* (2006.01)
*G09G 3/34* (2006.01)

(52) U.S. Cl.
CPC ..... *G09G 3/3413* (2013.01); *G09G 3/001* (2013.01); *G09G 2320/0242* (2013.01);
(Continued)

(58) Field of Classification Search
CPC ..... G09G 3/001; G09G 2320/0242; G09G 2320/0666; G09G 2320/0693; G09G 2354/00; G09G 2360/144; G09G 2360/145
See application file for complete search history.

(56) References Cited

U.S. PATENT DOCUMENTS 7,542,055 B2 * 6/2009 Matsuda ..... H04N 9/69 353/122
8,537,098 B2 * 9/2013 Atkins ..... G09G 3/20 345/102

(Continued)

OTHER PUBLICATIONS

Texas Instruments Incorporated, "System, Method, and Apparatus for Pulse-Width Modulation Sequence," specification filed in connection with U.S. Appl. No. 17/245,974, filed Apr. 30, 2021, 62 pages.

(Continued)

*Primary Examiner* — Gene W Lee
(74) *Attorney, Agent, or Firm* — Michelle F. Murray; Frank D. Cimino

(57) ABSTRACT

An example apparatus comprising: a controller configured to: access a content brightness map; determine an amplitude of a light emitting diode (LED) current based on the content brightness map, a target brightness, or a target color temperature; determine a pulse width modulation (PWM) sequence based on the content brightness map, the target brightness, or the target color temperature; determine an LED PWM signal based on the content brightness map, the target brightness, the target color temperature, or the amplitude of the LED current; transmit a signal indicating the LED current to an LED; transmit the PWM sequence to a spatial light modulator (SLM); and transmit the LED PWM signal to the LED.

20 Claims, 7 Drawing Sheets

(52) U.S. Cl.
CPC ..... *G09G 2320/0666* (2013.01); *G09G 2320/0693* (2013.01); *G09G 2354/00* (2013.01); *G09G 2360/144* (2013.01); *G09G 2360/145* (2013.01)

(56) References Cited

U.S. PATENT DOCUMENTS

| | | | | |
|---|---|---|---|---|
| 9,057,937 | B2 * | 6/2015 | Yamamoto | G09G 3/3413 |
| 9,613,576 | B2 * | 4/2017 | Yoshizawa | G09G 3/3611 |
| 10,032,402 | B2 | 7/2018 | Kempf | |
| 10,554,962 | B2 * | 2/2020 | Perdices-Gonzalez | G09G 3/3208 |
| 10,565,925 | B2 * | 2/2020 | Perdices-Gonzalez | G09G 3/348 |
| 2004/0233213 | A1 * | 11/2004 | Ohsawa | H04N 9/3147 345/589 |
| 2006/0126138 | A1 * | 6/2006 | Bala | H04N 9/3194 348/E17.005 |
| 2011/0317005 | A1 * | 12/2011 | Atkinson | H04N 13/254 348/E5.09 |
| 2013/0141699 | A1 * | 6/2013 | Yamamoto | G09G 3/002 353/121 |

OTHER PUBLICATIONS

Texas Instruments Incorporated, "System, Method, and Apparatus for Pulse-Width Modulation Sequence," figures filed in connection with U.S. Appl. No. 17/245,974, filed Apr. 30, 2021, 62 pages.

* cited by examiner

METHODS AND APPARATUS FOR A SELF-CALIBRATING AND ADAPTIVE DISPLAY

CROSS-REFERENCE TO RELATED APPLICATION

This patent application claims the benefit of and priority to U.S. Provisional Patent Application Ser. No. 63/288,052 filed Dec. 10, 2021, which is hereby incorporated herein by reference in its entirety.

TECHNICAL FIELD

This description relates generally to calibration, and more particularly to methods and apparatus for a self-calibrating and adaptive display.

BACKGROUND

Projectors are becoming increasingly complex as a result of ongoing developments in both manufacturing and optical technologies. For example, a combination of increasingly advanced manufacturing and optical light modulation methods have enabled high resolution, low distortion, and high contrast projectors to be readily available. Advanced projection technologies typically require complex calibration, prior to leaving a manufacturer, to ensure each projector meets specifications. Typically, manufacturers are required to perform comprehensive testing of each projection system to account for manufacturing variance of components, which alter the way in which light is modulated by the projection system, such as variations in light emitting diodes (LED) comprising an illumination source resulting in color temperature variances.

SUMMARY

For methods and apparatus for a self-calibrating and adaptive display, a controller configured to: access a content brightness map; determine an amplitude of a light emitting diode (LED) current based on the content brightness map, a target brightness, or a target color temperature; determine a pulse width modulation (PWM) sequence based on the content brightness map, the target brightness, or the target color temperature; determine an LED PWM signal based on the content brightness map, the target brightness, the target color temperature, or the amplitude of the LED current; transmit a signal indicating the LED current to an LED; transmit the PWM sequence to a spatial light modulator (SLM); and transmit the LED PWM signal to the LED.

BRIEF DESCRIPTION OF THE DRAWINGS

The same reference numbers or other reference designators are used in the drawings to designate the same or similar (functionally and/or structurally) features.

DETAILED DESCRIPTION

Figure 1:
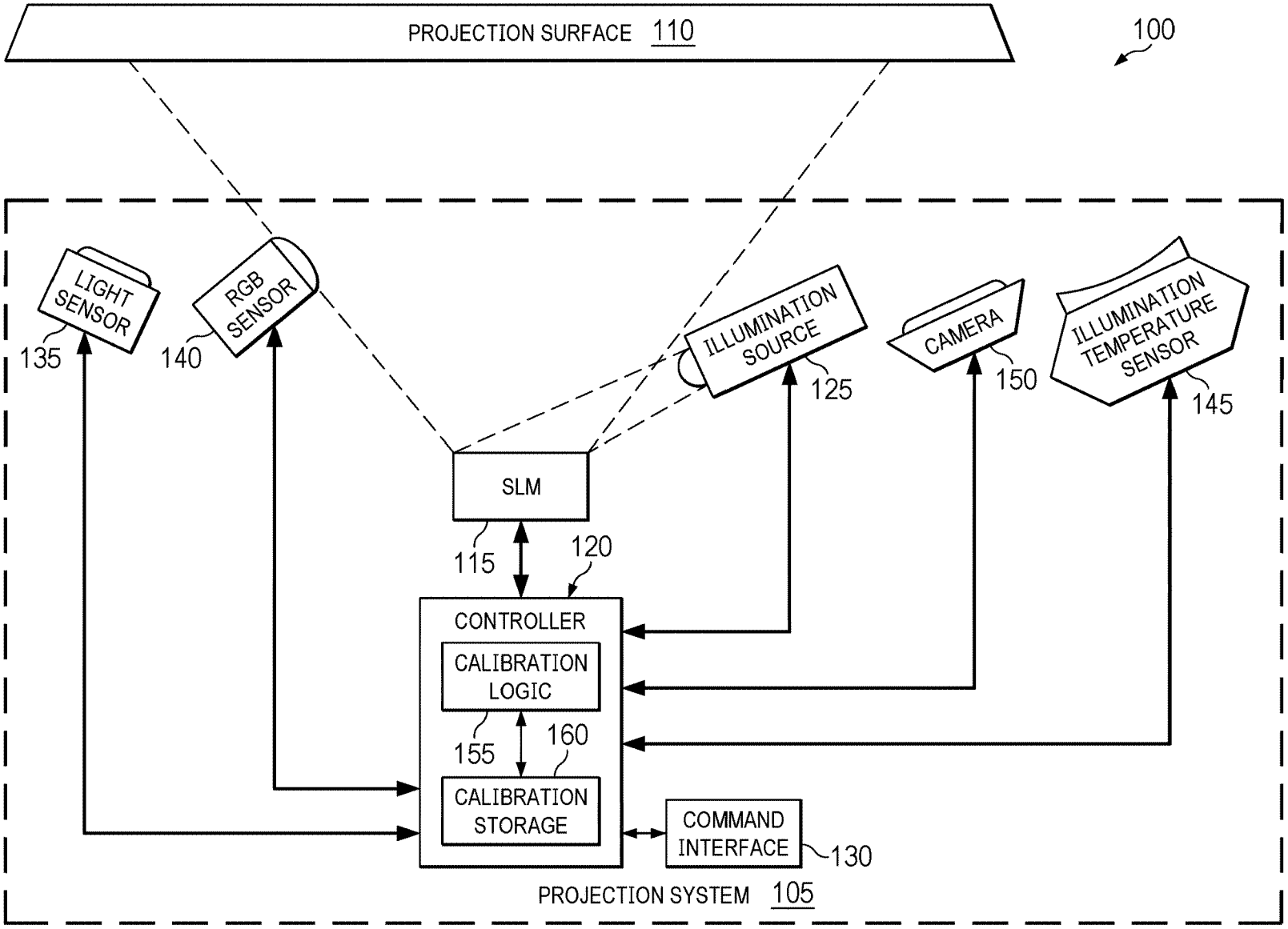
FIG. 1 is a block diagram of an example projection environment including an example projection system and projection surface.

The drawings are not necessarily to scale. Generally, the same reference numbers in the drawing(s) and this description refer to the same or like parts. Although the drawings show layers and regions with clean lines and boundaries, some or all of these lines and/or boundaries may be idealized. In reality, the boundaries and/or lines may be unobservable, blended and/or irregular.

Projection systems are becoming increasingly complex as a result of ongoing developments in both manufacturing and optical technologies. For example, a combination of increasingly advanced manufacturing and optical light modulation methods have enabled high resolution, low distortion, and high contrast projectors to be readily available. Projection systems use a combination of optical and electrical high performance and precision components to achieve performance requirements which result in higher picture quality, frame rates, and brightness. An example advanced projection system may include a controller capable of using pulse width modulation (PWM), current modulation, and color ratios to alter an image being projected. For example, the controller may increase a duty cycle of a PWM signal, electrically coupled to an LED illumination source, to change the color temperature of the light being produced. In such an example, the controller may increase the amplitude of the PWM signal to increase the brightness of the light being produced by the LED illumination source. Advanced projection systems typically lead to increased integration and manufacturing complexities, which may limit implementations of advanced optical technologies.

Advanced projection technologies involve complex calibration, prior to leaving a manufacturer, to ensure each projector meets specifications. Manufacturers may be required to perform comprehensive testing of each projection system to account for manufacturing variance of components. Manufacturing variances of high precision components results in variances in the light being modulated by the projection system. For example, an RGB sensor, used to determine a first color ratio of a first projection system, may determine a second color ratio of a second projection system to be different, despite the second projection system being produced immediately following the first projection system. In such an example, the RGB sensor may be used to calibrate the projection systems to have the same color ratios as a result of generating a unique firmware version for at least one of the projection systems, such that the light generated by the first projection system is approximately (preferably exactly) the same as the second projection system. Manufacturers may use a plurality of electrical and/or optical sensor circuitry (such as a combination of one or more of an RGB sensor, a camera, an ambient light sensor, etc.) to calibrate each projection system individually.

In application, projection systems may receive user inputs on preferences associated with values that may have been calibrated during the manufacturing process. For example, a user may increase the brightness of the projector to increase visibility in high ambient light conditions, such as using a projector in a well-lit room, near a window, etc. In such an example, the projection system may adjust the brightness by providing additional power to an illumination source. User input results in alterations to light being projected, which may cause perception issues (such as lower quality, brightness variations, etc.) as a result of the calibration values being determined based on operating conditions of a factory opposed to the operation conditions in the field. Additionally, the performance of the projection system drifts over the operational lifetime of the system as a result of components aging. For example, a brightness of a red LED comprising an illumination source may drift slightly over time, such that red light from the projector may appear dimmer than blue and/or green light. Performance drift of projection systems may be addressed by calibrating the projection system, similar to the calibration performed during manufacturing.

Examples described herein include methods and apparatus for a self-calibrating and adaptive display. In some described examples, a self-calibrating projection system may use a plurality of sensors (such as an RGB sensor, a camera, light sensor, etc.) comprising sensor circuitry, data from a controller, and/or characterization data to calibrate a projector, such that the calibration values are based on the operational conditions of the projection system in the field. The self-calibrating projection system determines calibration values a plurality of times over the operational lifetime of the projection system. For example, the self-calibrating projection system may determine calibration values every time the projection system turned on and/or upon determining a change in the content being projected by the system.

A method of self-calibration described herein enables a projection system to accurately adjust characteristics of the content being projected based on the operating conditions of a location of the projection system. For example, a self-calibrating projection system may increase a duty cycle of a PWM signal to adjust the color temperature of the light being produced based on user input and/or measured ambient light, such that the color temperature of the light is not based on the user input and ambient light of location of manufacturing. The self-calibration determines calibration values based on the age of the projection system, such that drift caused by component ageing may be compensated. Advantageously, the self-calibrating projection system reduces manufacturing complexity of advanced projection systems as a result of the self-calibrating projection system performing the calibration process that was typically performed prior to leaving the manufacturer. Advantageously, the self-calibrating projection system increases the duration of the operational lifetime wherein the projection system accurately projects light in accordance with specifications.

FIG. 1 is a block diagram of an example projection environment 100 including an example projection system 105 and an example projection surface 110. In the example of FIG. 1 the projection environment 100 is an example in the field implementation of the projection system 105. The projection environment 100 illustrates an example implementation of the projection system 105 wherein content is being projected onto the projection surface 110. The projection environment 100 may include one or more illumination sources (e.g., a lamp, window, light fixture, etc.) which may impact ambient light conditions, such that content being projected by the projection system 105 is perceived dimmer and/or of a different light temperature.

In the example of FIG. 1, the projection system 105 is optically coupled to the projection surface 110, such that the projection system 105 displays content onto the projection surface 110. In the example of FIG. 1, the projection system 105 includes an example spatial light modulator (SLM) 115, an example controller 120, an example illumination source 125, an example command interface 130, an example light sensor 135, an example RGB sensor 140, an example illumination temperature sensor 145, and an example camera 150. The projection system 105 may be configured to produce a projected image using the SLM 115, the controller 120, and the illumination source 125. The projection system 105 uses the command interface 130, the sensors 135-145, and the camera 150 to determine operating conditions of the projection system 105 in the projection environment 100. The projection system 105 may project images supplied to the controller 120 via the command interface 130, external media storage, or a multi-media data stream, such that the command interface 130 may be a data stream representative of media to generate a projected image. In the example of FIG. 1, the controller 120 receives image data from the command interface 130. Additionally, the command interface 130 may be coupled to a user interface, such that a user may provide an input to adjust the operation of the projection system 105. Advantageously, the projection system 105 may determine operating conditions for a wide variety of projection environments (e.g., the projection environment) as a result of the sensors 135-145 comprising the sensor circuitry, and the camera 150.

The SLM 115 is optically coupled to the projection surface 110 and the illumination source 125, such that the SLM 115 projects an image onto the projection surface 110 using light supplied by an optical output of the illumination source 125 to an optical input of the SLM 115. The SLM 115 is electrically coupled to the controller 120, such that the controller 120 may configure the SLM 115 to modulate light to project an image onto the projection surface 110. The SLM 115 modulates light supplied by the illumination source 125 to project content onto the projection surface 110. In an example, the SLM 115 is a digital micromirror device (DMD), a liquid crystal display (LCD), a liquid crystal on silicon (LCOS), a micoLED, etc.

The controller 120 is electrically coupled to the SLM 115, the illumination source 125, the command interface 130, the sensors 135-145, and the camera 150, such that the controller 120 may generate a signal on one or more electrical outputs coupled to one or more electrical inputs of the SLM 115 and the illumination source 125, such that the controller 120 may transmit signals to the SLM 115 and/or the illumination source 125. The controller 120 includes example calibration logic 155 and example calibration storage 160. The controller 120 configures the SLM 115 to modulate light based on the content intended to be projected by the projection system 105. The controller 120 configures the illumination source 125 to supply light to the SLM 115, such that the content projected by the projection system 105 may be viewed in a variety of colors. For example, the controller 120 may supply a PWM signal to the illumination source 125 to indicate a duration to enable a red light, a green light, and/or a blue light to generate the colors for content to be displayed. In such an example, the controller 120 may supply data to the SLM 115 to indicate a duration in which to modulate light corresponding to one or more pixels for one or more colors, such that light is reflected by the SLM 115 to project a plurality of colors. The controller 120 may receive user input from the command interface 130, such that calibration values may be based on user input. The controller 120 may receive sensor data from one or more of the sensors 135-145 comprising sensor circuitry and/or the camera 150 to determine calibration values corresponding to the projection environment 100. Alternatively, the controller 120 may be divided into one or more controllers. Advantageously, the controller 120 may determine operating conditions of the projection environment 100 based on the command interface 130, the sensors 135-145, and/or the camera 150. Advantageously, the controller 120 may modify the operations of the SLM 115 and/or the illumination source 125 as a result of the operating conditions.

The calibration logic 155 is electrically coupled to the calibration storage 160, such that the calibration logic 155 may access data included in the calibration storage 160. The calibration logic 155 determines, based the operating conditions of the projection environment 100, whether modifications of the data supplied to the SLM 115 and/or a PWM signal, supplied to the illumination source 125, are required to meet the specifications of the projection system 105 and/or user inputs. The calibration logic 155 may modify the color temperature, R:G:B ratios, brightness, and/or contrast of the light being projected by the projection system 105 as a result of modifying the SLM 115 and/or illumination source 125. For example, the calibration logic 155 may increase the amplitude of the PWM signal, supplied to the illumination source 125, as a result of determining based on the operating conditions that the brightness is lower than a value specified by a user. In such an example, the calibration logic 155 may use amplifier circuitry (such as an operation amplifier) to increase the current density of the PWM signal as a result of increasing the amplitude. Advantageously, the calibration logic 155 modifies the data supplied to the SLM 115 and/or the PWM signal to the illumination source 125 to account for calibration values, which are determined using the operating conditions of the projection environment 100.

The calibration storage 160 is electrically coupled to the calibration logic 155, such that the calibration storage 160 may include calibration values (e.g., target brightness, target color temperature, target R:G:B ratios, etc.). The calibration storage 160 stores data used by the controller 120 and/or the calibration logic 155 to determine calibration values based on the operating conditions, content being projected, user input, and/or characterization data (such as component specifications for operation drifts over time). For example, the calibration storage 160 may include a table and/or function representative of color drift of the illumination source 125 over time. In such an example, the calibration logic 155 may determine to modify the duty cycle of the PWM signal to account for the drift in color. The calibration storage 160 may store data specific to target operations of the projection system 105, such that the operations of the controller 120 may be modified to reach the target operations. For example, the calibration storage 160 may include preset values of color temperatures, R:G:B ratios, and/or brightness which may be enabled to enhance the perception of specific content (e.g., movies, presentations, screen mirroring, etc.). Alternatively, the calibration storage 160 may be included as a part of internal memory, a non-volatile storage medium, an external storage medium, etc. Advantageously, the calibration storage 160 enables the calibration logic 155 to modify the operations of the SLM 115 and/or the illumination source 125 based on functions, specifications, operation characteristics, etc.

The illumination source 125 is optically coupled to the SLM 115, such that the SLM 115 may modulate light supplied to the optical input by the optical output of the illumination source 125. The illumination source 125 is electrically coupled to the controller 120, such that the controller 120 may modify characteristics of the illumination source 125 (such as brightness, sequence times, color temperature, etc.) using an electrical input. The illumination source 125 is configured to produce illumination light based on characteristics of electrical signals from the controller 120. The illumination source 125 may include a plurality of LEDs corresponding to individual colors (not illustrated for simplicity), such that the SLM 115 may modulate light supplied by each LED to generate a wide range of colors. For example, the illumination source 125 may include a red LED, a green LED, and a blue LED to enable the SLM 115 to modulate portions of illumination light from each LED to create colors comprising of red, green, and/or blue. In such an example, the controller 120 may configure the SLM 115 to project a shade of the color purple by configuring the SLM 115 to project the red and blue light, from the LEDs, towards the projection surface 110 for a duration that enables the perceived color to be purple. Alternatively, the illumination source 125 may include a laser light source, a laser phosphor light source, etc. The illumination source 125 may supply illumination light of an increased brightness as a result of the controller 120 supplying the illumination source 125 with a power supply of a higher current density. Advantageously, the illumination source 125 enables the controller 120 to control the brightness and/or color temperature of illumination light being projected by the projection system 105.

The command interface 130 is electrically coupled to the controller 120, such that commands from an external device and/or a user may modify the operation of the calibration logic 155 and/or values stored in the calibration storage 160. The command interface 130 interacts with an external device coupled to the projection system 105 to enable the device and/or a user to define one or more preferences which alter the perception of light being projected. The external device may be a remote interface, a software-based interface, a control panel, a digital versatile disc (DVD) player, etc. For example, the user may modify settings of a DVD player to cause the DVD player to interface with the command interface 130 to indicate a reduction of the brightness of the content being projected. In such an example, the controller 120 may modify the calibration values to meet the reduction of brightness requirement set by external device commands. In the example of FIG. 1, the command interface 130 is a part of the projection system 105. Alternatively, the command interface 130 may be coupled to an additional interface to allow user input. Advantageously, the command interface 130 enables the calibration operations of the projection system 105 to account for target values set by the user. Advantageously, the command interface 130 allows users to adjust the operations of the projection system 105 based on perception preferences.

The sensors 135-145 are optically coupled to the projection surface 110, such that the sensors 135-145 may determine data related to the operating conditions of the projection environment 100 based on an optical input. The sensors 135-145 are electrically coupled to the controller 120, such that the controller 120 may receive one or more sensor signals on an electrical input from an electrical output of the sensors 135-145. A sensor signal may include data indicative of a value to be measured and/or determined by a sensor. The light sensor 135 determines a value representative of the ambient light in the projection environment 100. The RGB sensor 140 measures the R:G:B light intensity being projected by the projection system 105. The illumination temperature sensor 145 determines the temperature of the illumination sources in the projection system 105. Alternatively, the projection system 105 may include one or more of the sensors 135-145 to modify the integration complexity and/or cost of the projection system 105. Advantageously, the sensors 135-145 determine the operating conditions specific to the projection environment 100. Advantageously, the sensors 135-145 provide information on operating conditions to determine whether further calibration of the projection system 105 is required based on the output of the projection system 105.

The camera 150 is optically coupled to the projection surface 110, such that the image projected by the SLM 115 is captured by the camera 150. The camera 150 is electrically coupled to the controller 120, such that the controller 120 receives images captured by the camera 150. The camera 150 captures images of the projection surface 110, such that a hue of the projection surface 110 may be determined by the controller 120. For example, the controller 120 determines the hue of the projection surface 110 as a result of the camera 150 capturing an image of the projection surface 110 during a duration wherein the projection system 105 is not projecting content. In such an example, the determined hue may be used to determine a calibration value which may be used to correct the colors of the content being projected to compensate for color distortions caused by the hue of the projection surface 110. Alternatively, the camera 150 may be used to correct alignment issues, such as geometric misalignments that cause an image to be perceived as distorted. Advantageously, the camera 150 allows the controller 120 to correct the colors being projected by determining the hue of the projection surface 110.

In example operation, the projection system 105 determines calibration values as a result of the projection system 105 being powered, determines a change in the projection environment 100, and/or as a result of user input on the command interface 130. The controller 120 determines user preferences using the command interface 130, such user preferences may be referred to as target values. The controller 120 determines an ambient light value using the light sensor 135. The controller 120 determines an R:G:B ratio using the RGB sensor 140, and content being projected onto the projection surface 110. The controller 120 determines a color temperature value of the light being projected by the projection system 105 using the illumination temperature sensor 145. The controller 120 determines a hue value of the projection surface 110 using the camera 150.

In example operation, the controller 120 determines calibration values for the calibration logic 155 using the values determined by the command interface 130 and/or specifications of the projection system 105, the sensors 135-145, and/or the camera 150. The controller 120 may store determined calibration values to the calibration storage 160, such that the calibration values may be used to control the SLM 115 and/or the illumination source 125. The controller 120 may include circuitry to implement the calibration values using on the fly operations, such that the calibration logic 155 may modify the signals used to control the SLM 115 and/or the illumination source 125. Advantageously, the projection system 105 determines calibration values based on the operating conditions of the projection environment 100, such that the projection system 105 may determine calibration values based on the in the field operating conditions. Advantageously, the projection system 105 may confirm the accuracy of calibration values using the sensors 135-145 and/or the camera 150.

Figure 2:
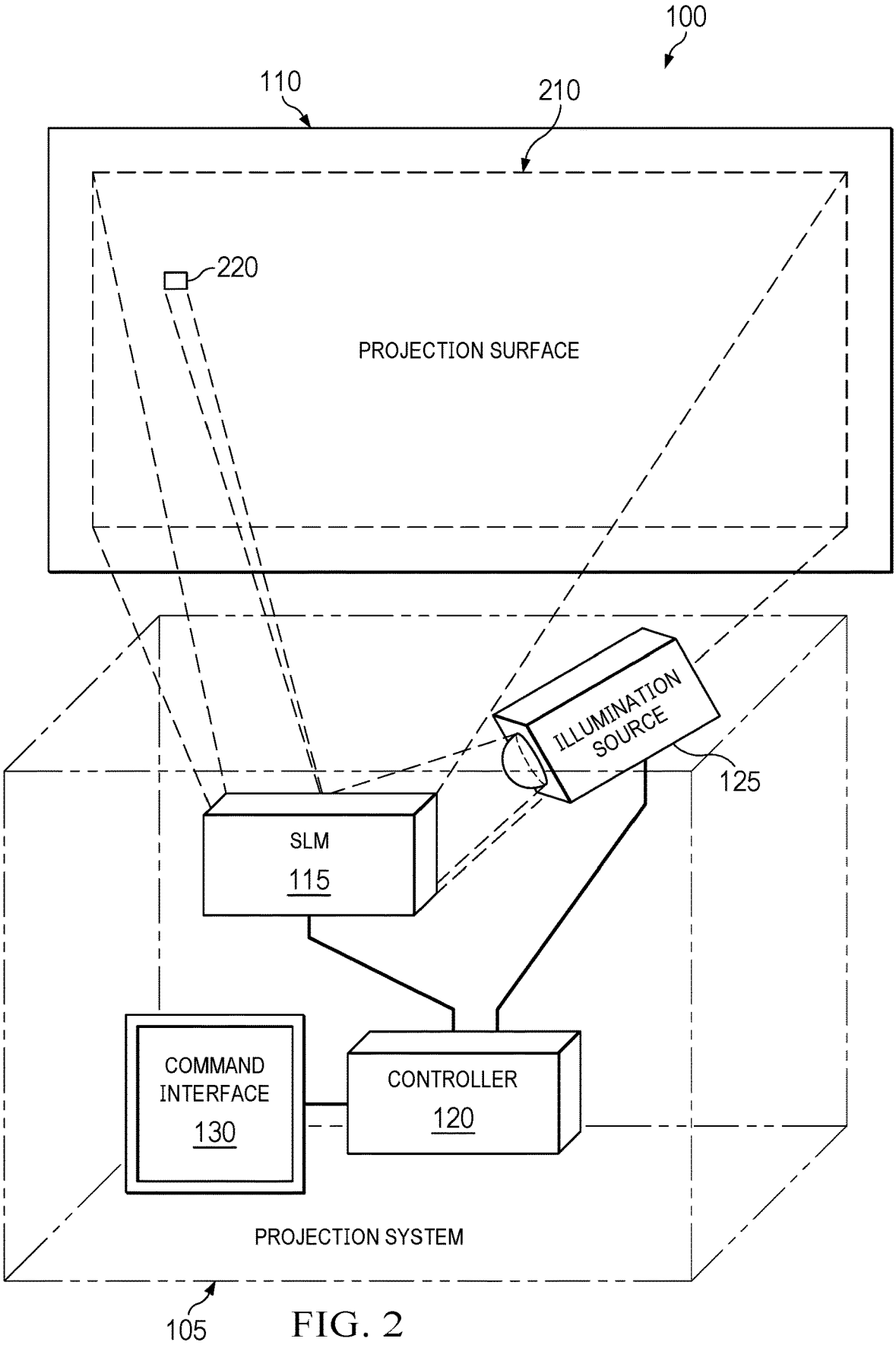
FIG. 2 is an isometric view of the projection environment of FIG. 1 including the projection system and projection surface of FIG. 1.

FIG. 2 is an isometric view of the projection environment 100 of FIG. 1 including the projection system 105 and projection surface 110 of FIG. 1. In the example of FIG. 2, the projection environment 100 includes the projection system 105 and the projection surface 110. The projection environment 100 represents an example implementation of the projection system 105 to project content onto the projection surface 110. The projection system 105 uses the SLM 115 and the illumination source 125 to project content onto the projection surface 110. The projection system 105 uses the controller 120 and the command interface 130 to implement calibration values to modify the content being projected. The projection surface 110 is optically coupled to the projection system 105, such that the SLM 115 modulates light to project content onto the projection surface 110. Alternatively, the SLM 115 may be configured to modulate light to project content onto a field of view of a user, such that the user perceives a virtual image. In the example of FIG. 2, the projection surface 110 includes an example field of view (FoV) 210 and an example portion 220.

The FoV 210 is an illustrative example area that the projection system 105 may project content onto, such that the projection system 105 may illuminate a portion of the FoV 210. For example, the projection system 105 configure the SLM 115 to illuminate the entire FoV 210 to a specific color as a result of modulating portions of each color comprising the specific color, such as purple requiring equal parts of red and blue light. The FoV 210 may be modified based on an orientation of the projection system 105 in relation to the projection system 105. For example, the area of the FoV 210 may be increased as a result of increasing the distance between the projection system 105 and the projection surface 110.

The portion 220 is an area of the FoV 210 that the projection system 105 may illuminate. For example, the portion 220 may represent one or more pixels comprising the content being projected. In such an example, the FoV 210 is comprised of a plurality of pixels, which combine to generate a perceivable image. The portion 220 may be modified by altering the resolution of the content being projected by the projection system 105. Alternatively, the portion 220 may represent a portion of the projection surface 110 determined to have alternate calibration values. For example, the portion 220 may have different calibration values compared to the rest of the FoV 210 as a result of the portion 220 having a different hue value compared to the other portion of the FoV 210.

Figure 3A:
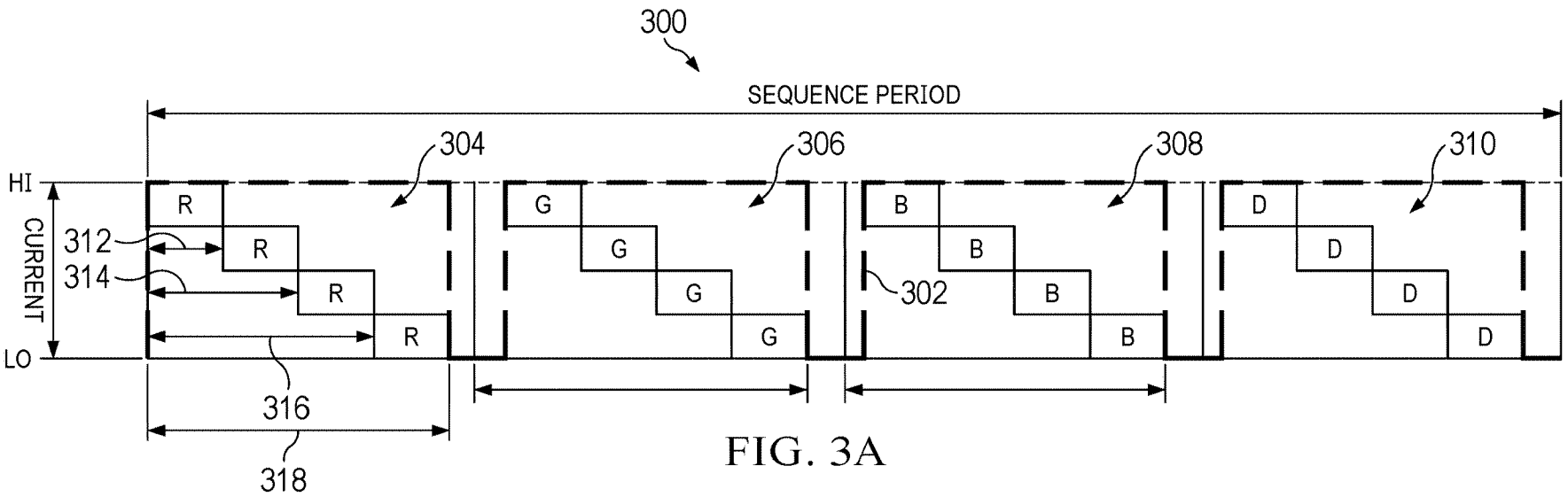
FIG. 3A is an illustration of a first example sequence used by an example DMD to project content based on an example pulse width modulation (PWM) signal.

FIG. 3A is an illustration of a first example sequence 300 used by an example DMD to project content based on an example pulse width modulation (PWM) signal 302. In the example of FIG. 1, the first sequence 300 is a signal generated by the controller 120 of FIGS. 1 and 2 to control operations of the SLM 115 of FIGS. 1 and 2. The first sequence 300 represents a duration, wherein one or more portions of the DMD (e.g., the portion 220 of FIG. 2) are configured to reflect light from the illumination source 125 of FIGS. 1 and 2 towards the projection surface 110 of FIGS. 1 and 2, as a logic high (HI) and durations, wherein the one or more portions of the DMD are configured to reflect light away from the projection surface 110, as a logic low (LO). In the example of FIG. 3A, the first sequence 300 includes the PWM signal 302, an example red color space 304, an example green color space 306, an example blue color space 308, and an example dark color space 310. The first sequence 300 illustrates potential colors which may be generated using the SLM 115 of FIG. 1 (e.g., a DMD, a LCD, a LCOS, a micoLED, etc.). For example, the DMD may illuminate the projection surface 110 of FIG. 1 blue as a result of setting the PWM signal 302 to a logic high (HI) during the duration of the first sequence 300 corresponding to the blue color space 308. In such an example, the shade of blue being projected by the DMD is based on the duty cycle of the PWM signal 302 corresponding to the blue color space 308. Advantageously, the SLM 115 may produce a plurality of colors based on a duty cycle of the PWM signal 302 in each of the color spaces 304-310.

The PWM signal 302 may be generated by the controller 120 of FIGS. 1 and 2 to configure the SLM 115 to modulate portions of light to generate a specific color. The PWM signal 302 instructs a portion of the SLM 115 to reflect light towards the projection surface 110 during a logic high (HI). The PWM signal 302 instructs the SLM 115 to reflect light away from the projection surface 110 as a logic low (LO). Alternatively, the SLM 115 may be configured to reflect light towards the projection surface 110 as a result of a logic low and away as a result of a logic high. For example, the color red is projected as a result of the PWM signal 302 being equal to a logic high for a duration of the red color space 304. Advantageously, the PWM signal 302 may modify the color of light being projected by the projection system 105 as a result of modifying the duty cycle of the PWM signal 302 in one or more of the color spaces 304-310.

The color spaces 304-310 illustrate portions of the first sequence 300 corresponding to a color of light which may be projected by the SLM 115. The red color space 304 represents the duration of the first sequence 300 that the color red may be projected. The green color space 306 represents the duration of the first sequence 300 that the color green may be projected. The blue color space 308 represents the duration of the first sequence 300 that the color blue may be projected. The dark color space 310 represents the duration of the first sequence 300 that the color black may be projected. Alternatively, the dark color space 310 may represent a duration in which no light is projected onto the projection surface 110, such that the color black is perceived. The color spaces 304-310 are of a duration of time, such that the combination of the light from each of the color spaces 304-310 are perceived as a blended color, such that color combinations of red, green, blue, and/or black may be generated. Blending of colors occurs as a result of the duration of each color contribution being of a duration less than a duration of which an eye may capture, such that the eye interprets the rapid succession of color contributions as a blending of all of the colors perceived. For example, the PWM signal 302 may be modified to project the color purple as a result of being a logic high during the durations of the first sequence 300 corresponding to the red color space 304 and blue color space 308 and a logic low during the durations of the first sequence 300 corresponding to the green color space 306 and the dark color space 310. In such an example, the color purple is perceived as a result of the durations of the color spaces 304-310 being of a length which causes a perception of a blending of the red and blue colors to generate a perceived purple color. The color spaces 304-310 include a first shade duty cycle 312, a second shade duty cycle 314, a third shade duty cycle 316, and a fourth shade duty cycle 318.

The shade duty cycles 312-318 represent the potential durations of the PWM signal 302 in each of the color spaces 304-310 that the illumination source 125 may have the color corresponding to that color space supplying light to the SLM 115, such that each of the duty cycles 312-318 correspond to a different contribution of each color. For example, a first shade of red may be projected by the SLM 115 as a result of the PWM signal 302 being a logic high in the red color space 304, a logic low in the color spaces 306-310, and the red light source in the illumination source being enabled for a duration equal to the first shade duty cycle 312. In such an example, a different shade of red may be perceived as a result of the red light source in the illumination source 125 supplying light to the SLM 115 for a duration corresponding to the shade duty cycles 314-318.

In example operation, the controller 120 generates the PWM signal 302 to generate a color for a portion of the projection surface 110 (e.g., the portion 220 of FIG. 2). The color generated by the PWM signal 302 is determined based on the combination of contributions from the color spaces 304-310, such that the colors are perceived as being blended together when projected by the projection system 105, as described above. Advantageously, a plurality of colors may be generated by the SLM 115 as a result of the shade duty cycles 312-318 allowing each of the color spaces 304-310 to contribute a portion of a perceived color.

Figure 3B:
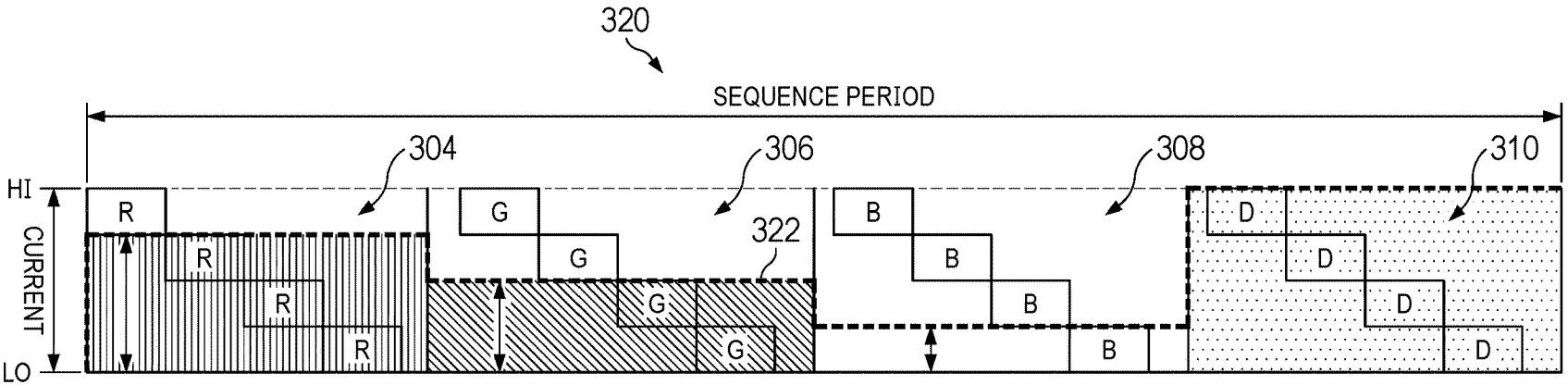
FIG. 3B is an illustration of a second example sequence used by a DMD to project content based on the PWM signal of FIG. 3A and an example light emitting diode (LED) current modulation signal.

FIG. 3B is an illustration of a second example sequence 320 of an example LED current modulation signal 322 configured to modify a brightness of color contributions based on an amplitude of the LED current modulation signal 322 during each of the color spaces 304-310. The second sequence 320 includes the color spaces 304-310, and the LED current modulation signal 322. The second sequence 320 illustrates the LED current modulation signal 322, generated by the controller 120 of FIGS. 1 and 2 and supplied to the illumination source 125 of FIGS. 1 and 2, to control a brightness of a color contribution based on the amplitude of the LED current modulation signal 322 during the duration of the second sequence 320 in a corresponding color space. The PWM signal 302 of FIG. 3A controls whether or not the SLM 115 of FIGS. 1 and 2 is projecting the color onto the projection surface 110 of FIGS. 1 and 2 whereas a brightness and/or intensity of each color contribution may be modified based a current density of the LED current modulation signal 322 in each of the color spaces 304-310. The PWM signal 302 represents a signal generated by the controller 120 to configure the SLM 115, such that the controller 120 may transmit the PWM signal 302 and/or the LED current modulation signal 322. The LED current modulation signal 322 represents a signal being generated by the controller 120 to configure the brightness of the illumination source 125. The brightness of the light supplied by the illumination source 125 may be modified by increasing or decreasing the amplitude of the LED current modulation signal 322, such that a different current density may be supplied for each of the durations wherein red, green, or blue light is being supplied to the SLM 115.

In the example of FIG. 3B, the LED current modulation signal 322 modifies the brightness of light being supplied by the illumination source 125 as a result of modifying the amplitude of the LED current modulation signal 322 in the color spaces 304-310. For example, the controller 120 may decrease the brightness of the red LED as a result of decreasing the amplitude of the LED current modulation signal 322 during duration corresponding to the red color space 304. The brightness of the illumination source 125 changes as a result in a change of current density of the LED current modulation signal 322 being supplied to the illumination source 125. The controller 120 may modify the LED current modulation signal 322 to modify the color temperatures of light being projected. For example, the controller 120 may modify the LED current modulation signal 322 to increase the amplitude during the blue color space 308 to achieve color temperatures which include a blue tint, such as color temperatures referred to as bright white, daylight, etc. Advantageously, the brightness of the content being projected may be modified as a result of modulating the amplitude of the LED current modulation signal 322. Advantageously, the operations of the PWM signal 302 are separate from operations of the LED current modulation signal 322.

Figure 3C:
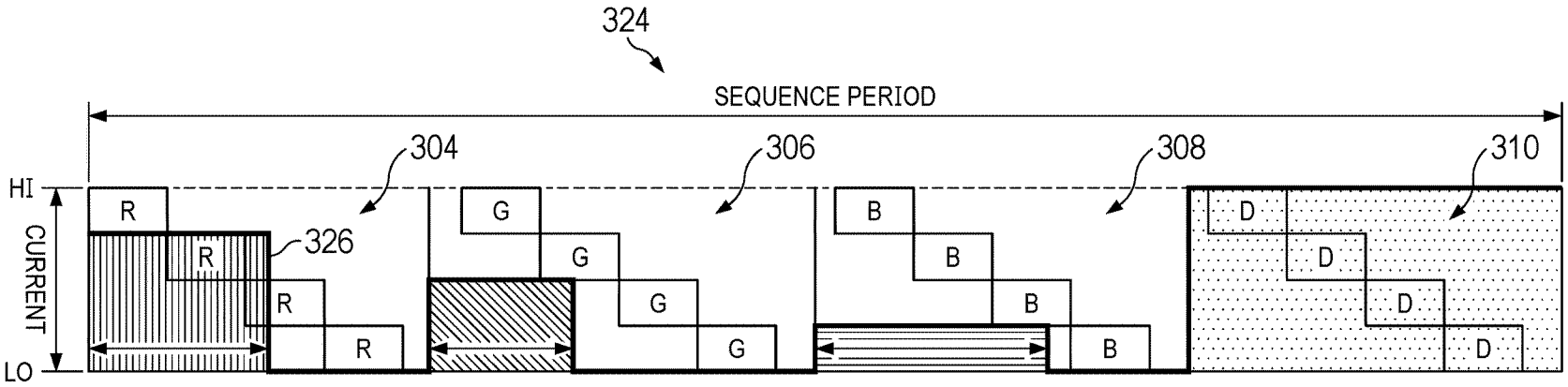
FIG. 3C is an illustration of a third example sequence used by a DMD to project a content based on the PWM signal of FIGS. 3A and 3B, the LED current modulation signal of FIG. 3B, and an example LED PWM signal.

FIG. 3C is an illustration of a third example sequence 324 of an example LED PWM signal 326 configured to modify a brightness of color contributions based on an amplitude of the LED PWM signal 326 during each of the color spaces 304-310. In the example of FIG. 3C, the third sequence 324 includes the color spaces 304-310 and the LED PWM signal 326. The third sequence 324 illustrates an example operation of the controller 120 of FIG. 1 wherein the PWM signal 302 of FIG. 3A controls the SLM 115 of FIG. 1, such that a logic high (HI) reflects light towards the projection surface 110 of FIG. 1 and a logic low (low) reflects light away from the projection surface 110. The third sequence 324 illustrates an amplitude modulation of the LED current modulation that is generated by the controller 120 to control the operations of the illumination source 125 of FIG. 1.

The third sequence 324 illustrates the LED PWM signal 326 as a combination of the amplitude modulation of the LED current modulation signal 322 and a duty cycle modulation, such that the controller 120 may supply a signal to the illumination source 125 which may modify the color temperature, shade, and/or brightness of the light being supplied. The LED PWM signal 326 represents a signal that may be generated by the controller 120 to control the brightness of the illumination source 125 as a result of modulating the amplitude. For example, the controller 120 may amplify the amplitude of the LED PWM signal 326 to increase the brightness of the illumination source 125 as a result of a higher current density being supplied to the illumination source 125. The LED PWM signal 326 may control the color temperature of the light being supplied by the illumination source as a result of modifying the duty cycle wherein the SLM 115 reflects light towards the projection surface and/or the amplitude of the LED PWM signal 326 in one or more of the color spaces 304-310. For example, the LED PWM signal 326 may decrease the color temperature of the light supplied to the SLM 115 as a result of decreasing the duty cycle of the pulse in the blue color space 308, such that the light supplied by the illumination source comprises of a higher blue hue. Advantageously, the controller 120 may modify the brightness, color temperature, and shade of light being supplied by the illumination source 125 as a result of modifying the duty cycle and amplitude of the LED PWM signal 326. Advantageously, the controller 120 may modify the projection system 105 of FIG. 1 using on the fly operations to adjust for operating conditions of the projection environment 100 of FIG. 1 by modulating the signals being supplied to the SLM 115 and/or the illumination source 125.

The controller 120 may be configured to set the duty cycle of the portions of the LED PWM signal 326 in each of the color spaces 304-310 to a maximum duty cycle, such that the illumination source 125 is configured to be disabled during durations of the color spaces 304-310 that colors are not reflected to perceive content. For example, the controller 120 may reduce the power consumed by the illumination source 125 as a result of setting the duty cycle of the LED PWM signal 326 in each color space to be approximately (preferably exactly) equal to a duty of the maximum duration required to achieve a color to be reflected by the SLM 115. In such an example, the power of the projection system 105 is reduced by a value approximately equal to the difference between the maximum duty cycle and a 100% duty cycle. The controller 120 may be configured to further decrease the duration wherein the illumination source 125 is enabled as a result of modifying the amplitude of the LED PWM signal 326. The controller 120 may lower the maximum duty cycle of the LED PWM signal 326 as a result of increasing the amplitude of the LED PWM signal 326 and lowering the duty cycle to preserve the power supplied to the illumination source 125. For example, a maximum red content brightness of 0.5 may be achieved by an original duty cycle of 0.4 (40%) or by an alternative duty cycle wherein the current density may be preserved, such that a multiplication of the duty cycle and amplitude using the original duty cycle and amplitude are approximately (preferably exactly) equal to the alternative duty cycle and alternative amplitude. In such an example, the maximum red content brightness 0.5 times the original duty cycle 0.4 may be multiplied to determine the alternative duty cycle of 0.2 may be used to achieve the same brightness, such that a duration that the illumination source 125 is enabled decreases by 30 percent. Advantageously, the controller 120 may decrease the power consumption of the projection system as a result of modifying the duty cycle of the LED PWM signal 326 to minimize the durations that the illumination source 125 is enabled. Advantageously, a first color of a first duty cycle and a maximum brightness may be generated using a second duty cycle approximately equal to the multiplication of the first duty cycle and the maximum brightness.

Figure 4C:
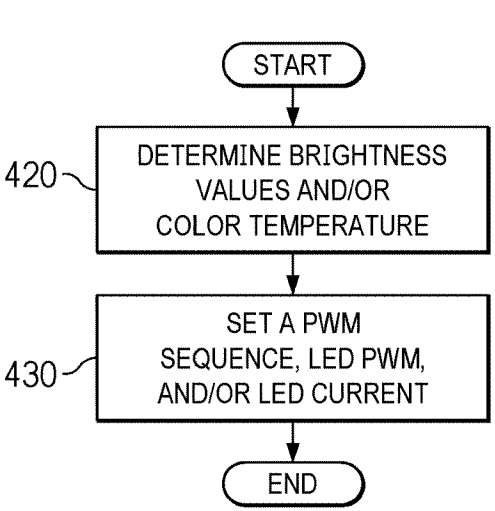
FIG. 4C is a flowchart representative of an example process that may be performed using machine readable instructions that can be executed and/or hardware configured to implement the sequences of FIGS. 3A-3C, and/or, more generally, the projection system of FIGS. 1 and 2 to determine a third example set of calibration values.
Figure 4B:
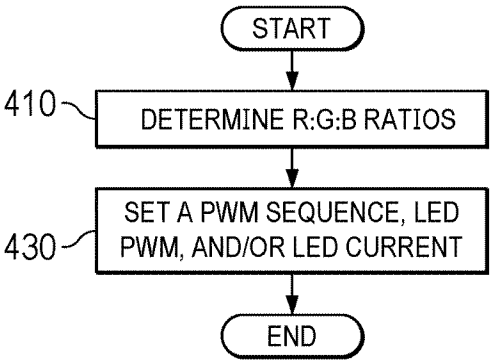
FIG. 4B is a flowchart representative of an example process that may be performed using machine readable instructions that can be executed and/or hardware configured to implement the sequences of FIGS. 3A-3C, and/or, more generally, the projection system of FIGS. 1 and 2 to determine a second example set of calibration values.
Figure 4A:
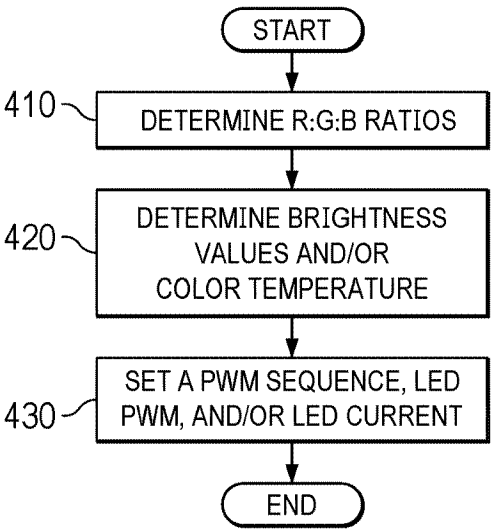
FIG. 4A is a flowchart representative of an example process that may be performed using machine readable instructions that can be executed and/or hardware configured to implement the sequences of FIGS. 3A-3C, and/or, more generally, the projection system of FIGS. 1 and 2 to determine a first example set of calibration values.

FIG. 4A is a flowchart representative of an example process that may be performed using machine readable instructions that can be executed and/or hardware configured to implement the sequences of FIGS. 3A-3C, and/or, more generally, the projection system 105 of FIGS. 1 and 2 to determine a first example set of calibration values. The projection system 105 begins at block 410. At block 410, the controller 120 of FIG. 1 determines red to green to blue (R:G:B) ratios. For example, the controller 120 use the RGB sensor 140 of FIG. 1 to determine an R:G:B ratio of light being projected by the SLM 115 of FIGS. 1 and 2. In such an example, the controller 120 may determine a calibrated R:G:B ratio based on the R:G:B ratio determined using the RGB sensor 140 and a target R:G:B ratio. At block 410, the controller 120 may determine a calibration value for an R:G:B ratio based on a comparison of a measured R:G:B ratio and a target R:G:B ratio. An R:G:B is a ratio of a red value (R) to a green value (G) to a blue value (B), which represent the contributions of the colors red, green, and blue used to create and/or perceive a color. For example, the projection system 105 may be configured to measure a red, green, and blue value using the RGB sensor 140 of FIG. 1 during a duration in time that the projection system 105 uses a target R:G:B ratio, corresponding to a shade of purple, to project the shade of purple onto the projection surface 110 to determine a measured R:G:B ratio corresponding to operations of the projection system 105 in the projection environment 100 of FIGS. 1 and 2. In such an example, the projection system 105 determines a calibration value to represent differences between the target R:G:B ratio and the measured R:G:B ratio, such that the calibration value enables the projection system 105 to project a color of a calibrated R:G:B ratio which is perceived as the target R:G:B ratio. Differences between the measured R:GR:G:B ratio and target R:G:B ratio may be a result of component ageing, ambient light conditions, a hue of the projection surface 110, etc. The target R:G:B ratio may be determined as a result of user input on the command interface 130 of FIG. 1, previous calibration values, content to be projected, and/or specifications of the projection system 105.

The calibration value determined based on a comparison of the measured R:G:B ratio and the target R:G:B ratio may be a parameterized value, an offset value, etc. For example, the projection system 105 may be configured to represent an R:G:B ratio as R:G:B, such that the calibration value, which is an offset calibration value, may be added to the target R:G:B ratio to generate a calibrated R:G:B ratio. In such an example, the calibrated R:G:B ratio is used to project colors which are perceived at an R:G:B value approximately (preferably exactly) equal to the target R:G:B ratio. Advantageously, the calibration value, determined at block 410, may be used to correct for differences between the target R:G:B ratio and the measured R:G:B ratio, such that content projected by the projection system 105 may be perceived at the target R:G:B ratio. Advantageously, the projection system 105 calibrates the R:G:B ratios of the light being projected based on calibration values determined based on the environment specific to the operations of the projection system 105, such that R:G:B ratios may be corrected to account for operating conditions of the projection environment 100. The projection system 105 proceeds to block 420.

At block 420, the projection system 105 determines brightness values and/or color temperature. For example, the controller may measure the brightness of the light being projected by the projection system 105 using the light sensor 135 of FIG. 1. In such an example, the controller 120 may measure the color temperature of the light being projected by the projection system 105 using the illumination temperature sensor 145 of FIG. 1. At block 420, the controller 120 may compare the values measured using the sensors 135 and 145 to target brightness and color temperature values to determine calibration values. For example, the projection system 105 may use the light sensor 135 and the illumination temperature sensor 145 to determine a measured brightness value and a measured color temperature value during a duration that the projection system 105 projects content using a target brightness and a target color temperature. In such an example, the projection system 105 determines one or more calibration values based on the difference between the target values, used to project the content, and the measured values, such that the projection system may use a calibrated brightness value and/or a calibrated color temperature value to project content whose measured values are approximately (preferably exactly) equal to the target values. The target values corresponding to the brightness and color temperature of the projection system may be determined by the controller 120 as a result of user input from the command interface 130, values specific to the content being projected, and/or specifications of the projection system 105.

The controller 120 may modify the color temperature and/or brightness of the light being projected by the projection system 105 by modulating the amplitude and/or duty cycle of the signals generated to control the SLM 115 and/or illumination source 125. For example, the calibration logic 155 of FIG. 1 may be configured to select a gain of an amplifier corresponding to a calibration value to increase or decrease an amplitude of a signal (e.g., the LED current modulation signal 322 of FIG. 3B) being supplied to the illumination source 125. In such an example, the modification of the signal enables the projection system 105 to project content, such that it is perceived at a color temperature and/or a brightness that is approximately (preferably exactly) equal to the target color temperature and the target brightness. Advantageously, the projection system 105 may determine calibration values for brightness and/or color temperature specific to the projection environment 100 as a result of the sensors 135 and 145. Advantageously, the controller 120 may perform on the fly operations to the signals supplied to the SLM 115 and illumination source 125 to correct the brightness and/or color temperature to be approximately equal to target values. The projection system 105 proceeds to block 430.

At block 430, the projection system 105 sets a PWM sequence, LED PWM, and/or LED current. The controller 120 determines a maximum duty cycle for each color of light supplied from the illumination source 125, corresponding to the color spaces 304-310, based on at least one of a content brightness map or calibration values. The controller 120 may increase power efficiency as a result of disabling the illumination source during the durations wherein light is not reflected, such that the illumination source 125 is enabled only during durations wherein the color of light is being projected. The controller 120 may determine the amplitude and/or duty cycle of the LED PWM signal 326 of FIG. 3C based on the maximum duty cycle. Example circuitry to determine and/or generate a PWM sequence, LED PWM, and/or LED current signal for the illumination source 125 based on color temperature and/or brightness are shown in co-assigned U.S. Pat. No. 17,245,974 (of which is incorporated by reference in their entirety). The controller may set an LED PWM for the illumination source 125 to account for calibration values of the color temperature, determined at block 420. For example, the controller 120 may adjust the color temperature of the light supplied by the illumination source 125 as a result of modifying the duty cycle of the LED PWM signal 326 of FIG. 3C. The controller may set an LED current for the illumination source 125 to account for calibration values of the color temperature and/or brightness, determined at block 420, as a result of modifying the current density of the signal controlling the illumination source 125. For example, the controller 120 may adjust the brightness of the illumination source 125 as a result of adjusting the amplitude of the LED current modulation signal 322 of FIGS. 3B and/or the LED PWM signal 326 of FIG. 3C in each of the color spaces 304-310 of FIGS. 3A-3C, such that the brightness is increased as a result of increasing the amplitude. Advantageously, the controller 120 may modify the brightness, color temperature, and/or R:G:B ratios to account for calibration values as a result of modifying the signals 302, 322, and/or 326. The projection system 105 proceeds to end calibration operations.

Although example methods are described with reference to the flowchart illustrated in FIG. 4A, many other methods of determining and/or setting calibration values for the projection system 105 may alternatively be used in accordance with this description. For example, the order of execution of the blocks may be changed, and/or some of the blocks described may be changed, eliminated, or combined. Similarly, additional operations may be included in the manufacturing process before, in between, or after the blocks shown in the illustrated examples.

FIG. 4B is a flowchart representative of an example process that may be performed using machine readable instructions that can be executed and/or hardware configured to implement the sequences of FIGS. 3A-3C, and/or, more generally, the projection system 105 of FIGS. 1 and 2 to determine a second example set of calibration values. The projection system 105 may begin to determine calibration values at block 410. Block 410 of FIG. 4B is similar to block 410 of FIG. 4A, unless otherwise stated. The projection system 105 proceeds to block 430. Block 430 of FIG. 4B is similar to block 430 of FIG. 4A, unless otherwise stated. In the example of FIG. 4B, the projection system may include the SLM 115, the controller 120, the illumination source 125, the command interface 130, and the RGB sensor 140 of FIG. 1. Advantageously, the integration complexity and cost of the process of FIG. 4B is reduced compared to the complexity and cost of the process of FIG. 4A as a result of reducing the number of sensors required to calibrate the projection system 105, such that the process of FIG. 4B is not required to include the light sensor 135 and the illumination temperature sensor 145 of FIG. 1.

Although example methods are described with reference to the flowchart illustrated in FIG. 4B, many other methods of determining and/or setting calibration values for the projection system 105 may alternatively be used in accordance with this description. For example, the order of execution of the blocks may be changed, and/or some of the blocks described may be changed, eliminated, or combined. Similarly, additional operations may be included in the manufacturing process before, in between, or after the blocks shown in the illustrated examples.

FIG. 4C is a flowchart representative of an example process that may be performed using machine readable instructions that can be executed and/or hardware configured to implement the sequences of FIGS. 3A-3C, and/or, more generally, the projection system of FIGS. 1 and 2 to determine a third example set of calibration values. The projection system 105 may begin to determine calibration values at block 420. Block 420 of FIG. 4C is similar to block 420 of FIG. 4A, unless otherwise stated. The projection system 105 proceeds to block 430. Block 430 of FIG. 4C is similar to block 430 of FIG. 4A, unless otherwise stated. In the example of FIG. 4C, the projection system may include the SLM 115, the controller 120, the illumination source 125, the command interface 130, the light sensor 135, and the illumination temperature sensor 145 of FIG. 1. Advantageously, the integration complexity and cost of the process of FIG. 4B is reduced compared to the complexity and cost of the process of FIG. 4A as a result of reducing the number of sensors required to calibrate the projection system 105.

Although example methods are described with reference to the flowchart illustrated in FIG. 4C, many other methods of determining and/or setting calibration values for the projection system 105 may alternatively be used in accordance with this description. For example, the order of execution of the blocks may be changed, and/or some of the blocks described may be changed, eliminated, or combined. Similarly, additional operations may be included in the manufacturing process before, in between, or after the blocks shown in the illustrated examples.

Figure 5:
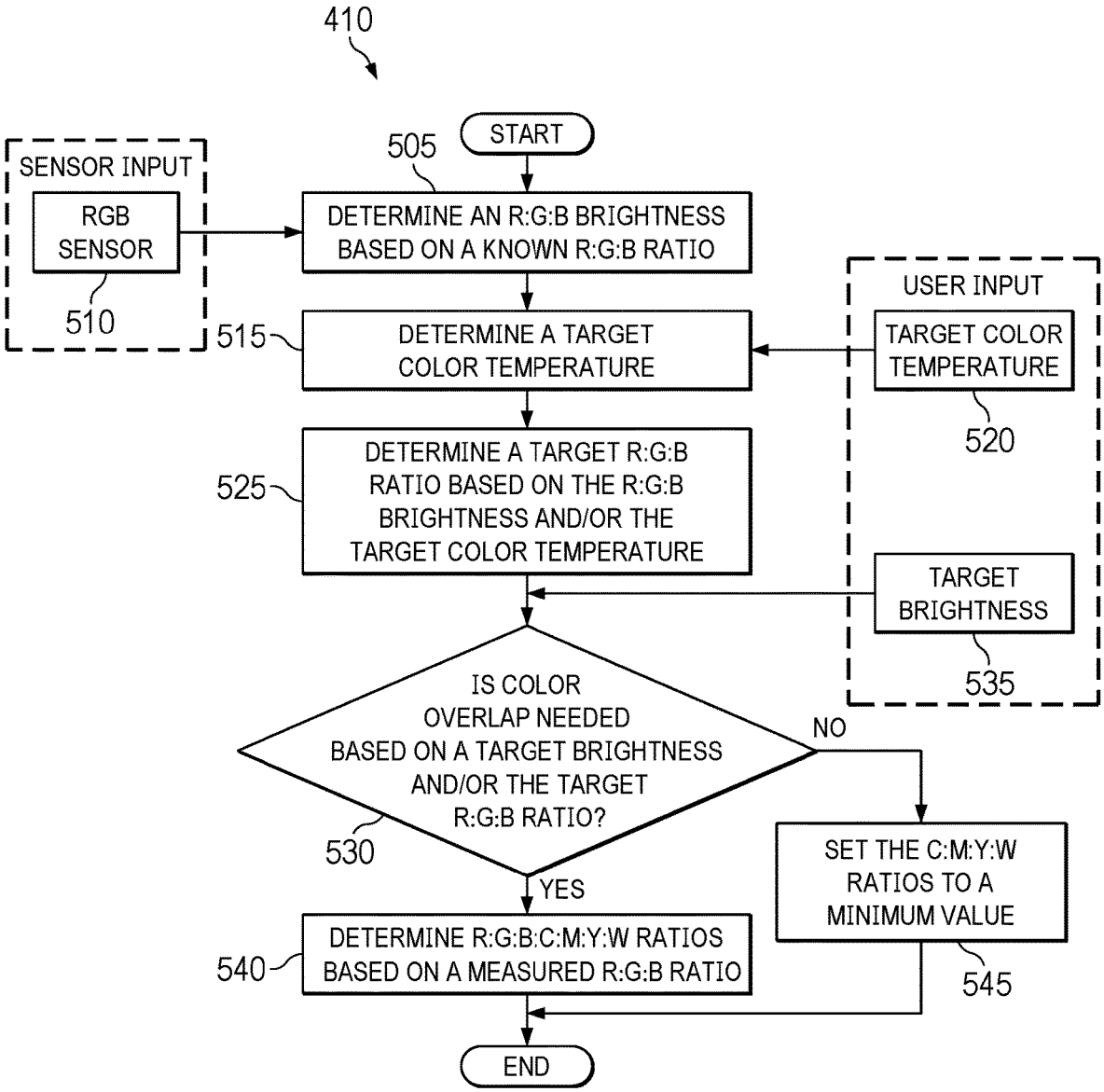
FIG. 5 is a flowchart representative of an example process that may be performed using machine readable instructions that can be executed and/or hardware configured to implement the projection system of FIGS. 1 and 2, and/or, more generally, to determine color ratios of the projection system of FIGS. 1 and 2.

FIG. 5 is a flowchart representative of an example process of block 410 of FIGS. 4A and 4B that may be performed using machine readable instructions that can be executed and/or hardware configured to implement the projection system of FIGS. 1 and 2, and/or, more generally, to determine color ratios of the projection system of FIGS. 1 and 2. The projection system 105 begins the process of FIG. 5 at block 505. At block 505, the controller 120 of FIG. 1 determines an R:G:B brightness for a predetermined R:G:B ratio. The predetermined R:G:B ratio is the R:G:B ratio used by the controller 120 to configure the SLM 115 and illumination source 125 to project content, which is measured to determine the R:G:B brightness. For example, the controller 120 may generate a PWM signal to configure the SLM 115 (e.g., the PWM signal 302 of FIG. 3A) and an LED PWM signal to configure the illumination source 125 (e.g., the LED PWM signal 326) to project a color with a predetermined red contribution, a predetermined green contribution, and a predetermined blue contribution, such that a ratio of the predetermined contributions comprise the predetermined R:G:B ratio. At block 505, the controller 120 may receive sensor input from block 510.

At block 510, the RGB sensor 140 measures the light being projected by the projection system 105 to generate a value representative of the R:G:B brightness before calibration. For example, the RGB sensor 140 may be configured to measure a red contribution, a green contribution, and a blue contribution during a duration that the projection system 105 is projecting content with a predetermined red, green, and blue contribution. The projection system 105 proceeds to block 515.

At block 515, the controller 120 determines a target color temperature. At block 515, the controller 120 may receive user input from block 520. At block 520, the controller 120 may receive a value specifying a target color temperature from the user. For example, the user may set the target color temperature as a result of using the command interface 130 of FIGS. 1 and 2. In another example, the controller 120 may determine the target color temperature as a result of a value stored in the calibration storage 160 of FIG. 1. Alternatively, the target color temperature may be determined based on the content to be projected by the projection system 105, such that the target color temperature may be determined using a content brightness map. Advantageously, the projection system 105 may adjust color ratios based on the target color temperature. The projection system 105 proceeds to block 525.

At block 525, the controller 120 determines a target R:G:B ratio based on the R:G:B brightness and/or the target color temperature. At block 525, the controller 120 may compare the R:G:B brightness values, determined using the RGB sensor 140 at block 510, to the predetermined R:G:B ratio to determine a value representative of differences between the values. For example, the controller 120 may determine a calibration value to correct the predetermined R:G:B ratio, such that the R:G:B brightness values measured by the RGB sensor 140 are approximately (preferably exactly) equal to the predetermined R:G:B values. In such an example, the predetermined R:G:B values may be modified based on the calibration values to generate a target R:G:B ratio to be used to configure the projection system 105 of FIGS. 1 and 2. At block 525, the controller 120 may further modify the calibration values corresponding to the R:G:B ratio based on the target color temperature. For example, the controller 120 may determine an R:G:B ratio which corresponds to the target color temperature determined at block 515. In such an example, the R:G:B ratio determined to represent the target color temperature is the target R:G:B ratio which corresponds to light being perceived at approximately the target color temperature. Alternatively, the controller 120 may determine the target R:G:B ratio for the target color temperature as a result of locating an R:G:B ratio associated with the target color temperature, accessing an R:G:B ratio stored in the calibration storage 160 of FIG. 1, etc. Advantageously, the controller 120 determines a target for the calibration of the R:G:B ratio of the projection system 105 based on the target color temperature. The projection system 105 proceeds to block 530.

At block 530, the controller 120 determines if color overlap is needed based on a target brightness and/or the target R:G:B ratio. For example, the controller 120 may determine that one of the colors cyan, magenta, yellow, and/or white may be required to achieve the target color temperature at the target brightness. In such an example, the color cyan may be used in instances where the target color temperature and/or brightness are increased and/or the projection environment 100 has a high yellow illumination impact on the R:G:B ratio determined by the RGB sensor 140 at block 510. At block 530, the controller 120 may receive user input from block 535. At block 535, the controller 120 receives and/or determines the target brightness based on user input. At block 530, the controller 120 may determine color overlap is required to achieve the target R:G:B ratio at the target brightness. For example, the controller 120 may determine that a yellow color space may be needed to achieve the target R:G:B ratio at the target brightness. In such an example, the controller 120 may enable an individual color space for each of the additional colors cyan, magenta, yellow, and/or white to generate an LED PWM signal corresponding to the target R:G:B ratio at the target brightness. The projection system 105 proceeds to block 540 as a result of determining color overlap is required to achieve the target brightness and/or required R:G:B ratio. The projection system 105 proceeds to block 545 as a result of determining that color overlap is not required to achieve the target brightness and/or required R:G:B ratio.

At block 540, the controller 120 determines red, green, blue, cyan, magenta, yellow, and white (R:G:B:C:M:Y:W) ratios based on a measured R:G:B ratio. The controller 120 may determine values for each of the R:G:B:C:M:Y:W colors based a comparison of the value measured at block 510 by the RGB sensor 140, the required R:G:B ratio determined at block 525, and/or the target brightness from block 535. For example, the controller 120 may add a color space to the color spaces 304-310 to represent the additional cyan, magenta, yellow, and white colors, such that the controller 120 may add contributions from the additional color space. In such an example, the controller 120 may store the determined ratios in the calibration storage 160. The controller 120 may determine an amplitude and/or duty cycle of an LED PWM signal with additional color spaces based on a ratio of the additional color compared to previous colors. For example, the controller 120 may generate a pulse in a yellow color space to replace the need for a pulse in both the green and red color spaces. At block 540, the controller 120 sets the R:G:B:C:M:Y:W values to generate a ratio which enables the projection system 105 to project light of the target color temperature and/or target brightness. Advantageously, the projection system 105 may calibrate the R:G:B:C:M:Y:W ratios to achieve target operations of the light being projected based on the operating conditions of the projection environment 100. The projection system 105 proceeds to end the process of block 410.

At block 545, the controller 120 sets the cyan, magenta, yellow, and white (C:M:Y:W) ratios to a minimum value. For example, the controller 120 may set the values of the C:M:Y:W colors to approximately zero as a result of determining color overlap is not required to achieve the required R:G:B ratio, target brightness, and/or specification requirements. In such an example the ratios may be stored in the calibration storage 160. The controller 120 may decrease integration complexity of the projection system 105 as a result of disabling the C:M:Y:W colors during operations wherein they are not required, such that the C:M:Y:W values are disabled as a result of setting the values to approximately zero. The projection system 105 proceeds to end the process of block 410.

Although example methods are described with reference to the flowchart illustrated in FIG. 5, many other methods of determining and/or setting R:G:B ratio calibration values for the projection system 105 alternatively be used in accordance with this description. For example, the order of execution of the blocks may be changed, and/or some of the blocks described may be changed, eliminated, or combined. Similarly, additional operations may be included in the manufacturing process before, in between, or after the blocks shown in the illustrated examples.

Figure 6:
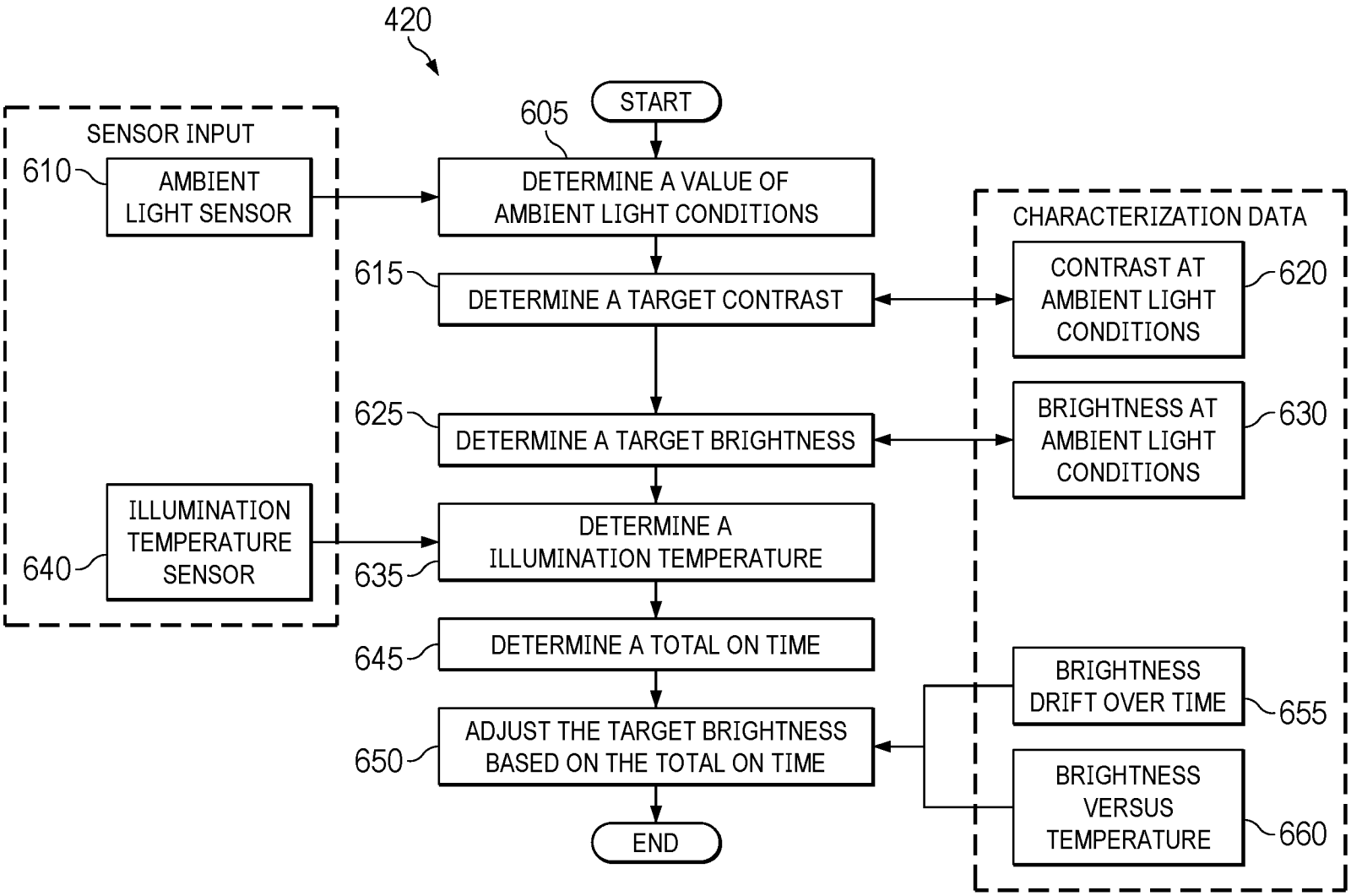
FIG. 6 is a flowchart representative of an example process that may be performed using machine readable instructions that can be executed and/or hardware configured to implement the projection system of FIGS. 1 and 2, and/or, more generally, to determine color temperature and brightness of the projection system of FIGS. 1 and 2.

FIG. 6 is a flowchart representative of an example process of block 420 of FIGS. 4A and 4C that may be performed using machine readable instructions that can be executed and/or hardware configured to implement the projection system of FIGS. 1 and 2, and/or, more generally, to determine color temperature and brightness of the projection system 105 of FIGS. 1 and 2. The projection system 105 begins the process of block 420 at block 605. At block 605, the controller 120 determines a value of ambient light conditions. At block 605, the controller 120 may receive an input from block 610. At block 610, the light sensor 135 of FIG. 1 measures the ambient light conditions of the projection environment 100 of FIG. 1. At block 605, the controller 120 may determine the value of the ambient light conditions of the projection environment 100 based on sensor input and/or a value stored in the calibration storage. For example, the light sensor 135 may determine a value of the ambient light conditions of the projection environment during a duration wherein the projection system 105 is not projecting content onto the projection surface 110 of FIG. 1. Advantageously, the projection system 105 determines a value representative of the ambient light conditions specific to the projection environment 100. The projection system 105 proceeds to block 615.

At block 615, the controller 120 determines a target contrast. At block 615, the controller 120 may determine the target contrast as a result of determining a contrast value at the ambient light conditions determined at block 605. The controller 120 may use the characterization data at block 620 to determine the contrast value at the ambient light conditions. At block 620, the controller 120 may set the contrast value as a result of accessing manufacturer provided characterization data of contrast values across a range of ambient light conditions. Alternatively, the projection system 105 may determine the contrast value as a result of using one or more of the sensors 135-145 and/or camera 150 of FIG. 1 to determine the contrast value. Advantageously, the target contrast is determined based on the ambient light conditions of the projection environment 100. Advantageously, the projection system 105 may modify the target contrast as a result of determining a change in ambient light conditions. The projection system 105 proceeds to block 625.

At block 625, the controller 120 determines a target brightness. At block 625, the controller 120 may determine the target brightness as a result of determining a brightness value at the ambient light conditions determined at block 605. The controller 120 may use the characterization data at block 630 to determine the brightness value at the ambient light conditions. At block 625, the controller 120 may set the brightness value as a result of accessing manufacturer provided characterization data of brightness values across a range of ambient light conditions. Alternatively, the projection system 105 may determine the brightness value as a result of using one or more of the sensors 135-145 and/or camera 150 to determine the brightness value. Advantageously, the target brightness is determined based on the ambient light conditions of the projection environment 100. Advantageously, the projection system 105 may modify the target brightness as a result of determining a change in the ambient light conditions. The projection system 105 proceeds to block 635.

At block 635, the controller determines an illumination temperature. At block 635, the controller 120 may determine the illumination temperature as a result of receiving a sensor input from block 640. At block 640, the illumination temperature sensor 145 measures an illumination level in lux, which corresponds to a color temperature in Kelvins. The color temperature of the light being projected may be determined based on a range of lux values of the light being projected by the projection system 105. For example, the controller 120 may approximate a measured illumination level of 300 lux as warm white of approximately 3000 Kelvin. At block 635, the controller 120 may determine a range of color temperatures to represent the illumination temperature of the light being projected. For example, the controller 120 may generate a range of illumination temperatures as a result of a plurality of measurements from the illumination temperature sensor 145 across a plurality of frames of content being projected by the projection system 105. Alternatively, the projection system 105 may use one or more of the sensors 135 and 140, and/or camera 150 to determine the illumination temperature. Advantageously, the projection system 105 determines the illumination temperature of light being projected based on the operating conditions of the projections environment 100. The projection system 105 proceeds to block 645.

At block 645, the controller 120 determines a total on time. The total on time represents the total time that the SLM 115 has projected content, since the time of manufacture. For example, the controller 120 may store a value in the calibration storage 160 of FIG. 1 that represents the duration of time wherein the projection system 105 has projected content. In such an example, the controller 120 may modify the value stored in the calibration storage 160 every time the projection system is powered on and/or as a step in the process of powering off the projection system 105. At block 645, the controller 120 may combine all of the durations of time wherein the projection system 105 was powered and/or being used to display content. Advantageously, the projection system 105 stores a value representing the age of components comprising the projection system 105. The projection system 105 proceeds to block 650.

At block 650, the controller 120 adjusts the target brightness based on the total on time. At block 650, the controller 120 may adjust the target brightness as a result of determining a brightness drift value over the duration of time determine at block 645. The controller 120 may use the characterization data at blocks 655 and 660 to determine the brightness drift value over a given amount of time. At block 655, the controller 120 determine the brightness drift value as a result of accessing manufacturer provided characterization data of brightness drift values across a range of time. For example, the controller 120 may multiply the duration of time determined at block 645 by a scaler value representative of the drift in operation for a given amount of time to determine the brightness drift value. At block 660, the controller 120 may determine the color temperatures contribution to the brightness drift value over time as a result of accessing manufacturer provided characterization data of brightness drift for a range of color temperatures. For example, a low color temperature may appear to have a yellow tint and of a reduced brightness compared to a high color temperature with a blue tint. Advantageously, the projection system 105 may determine calibration values which account for performance drifts of components comprising the projection system 105. The projection system 105 proceeds to end the process of determining calibration values for block 420.

Although example methods are described with reference to the flowchart illustrated in FIG. 6, many other methods of determining and/or setting calibration values for the color temperature and/or brightness of the projection system 105 may alternatively be used in accordance with this description. For example, the order of execution of the blocks may be changed, and/or some of the blocks described may be changed, eliminated, or combined. Similarly, additional operations may be included in the manufacturing process before, in between, or after the blocks shown in the illustrated examples.

Figure 7:
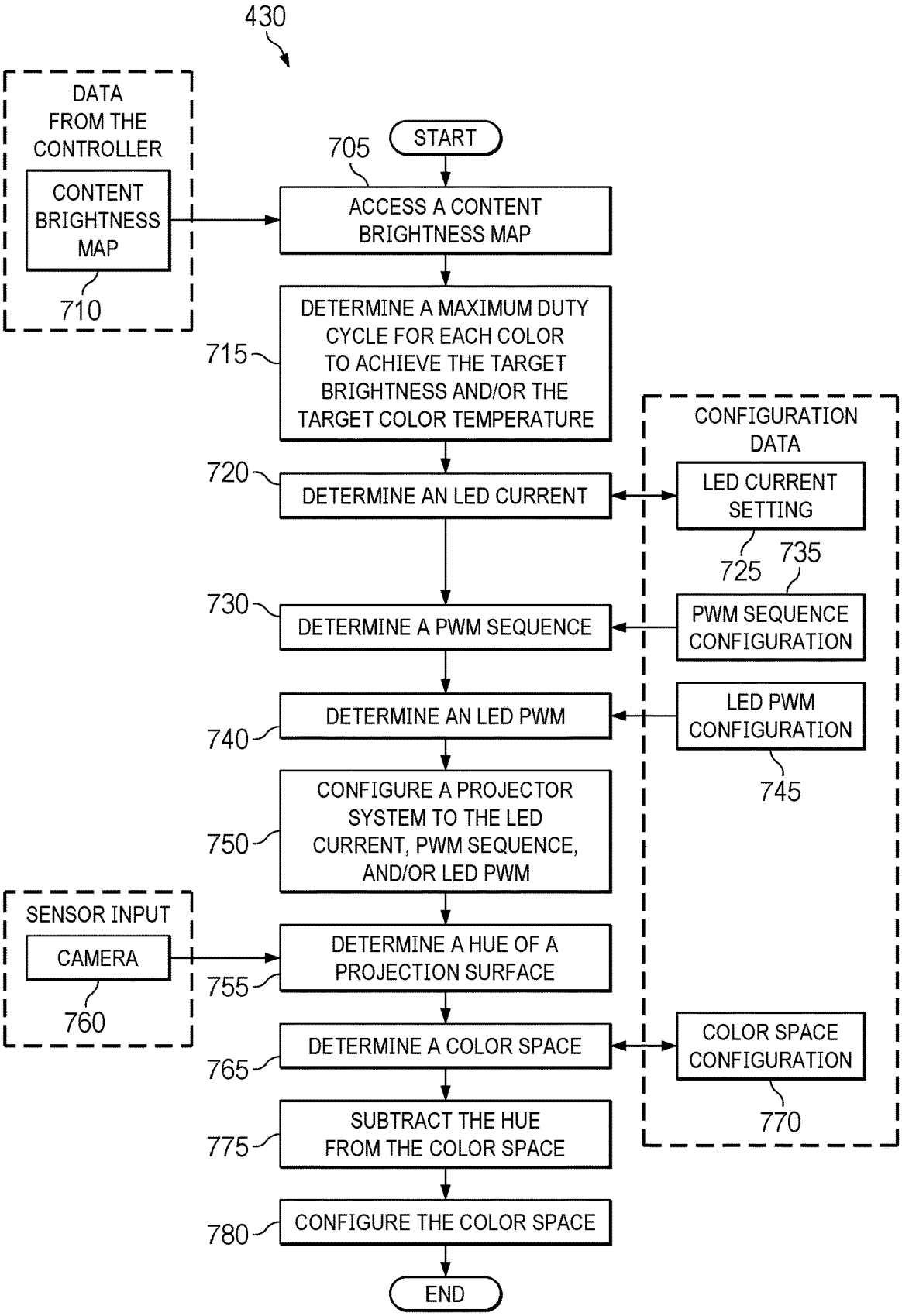
FIG. 7 is a flowchart representative of an example process that may be performed using machine readable instructions that can be executed and/or hardware configured to implement the projection system of FIGS. 1 and 2, and/or, more generally, to determine the PWM signal, the LED current modulation, and the LED PWM modulation of FIGS. 3A-3C.

FIG. 7 is a flowchart representative of an example process of block 430 of FIGS. 4A-4C that may be performed using machine readable instructions that can be executed and/or hardware configured to implement the projection system of FIGS. 1 and 2, and/or, more generally, to determine the PWM signal, the LED current modulation, and the LED PWM modulation of FIGS. 3A-3C. The projection system 105 begins at block 705. At block 705, the controller accesses a content brightness map. At block 705, the controller 120 may access the content brightness map as a result of receiving an input from block 710, such that the content brightness map may be stored in the calibration storage 160 of FIG. 1 and/or provided by the command interface 130. At block 710, the controller 120 receives a content brightness map based on the content to be projected by the projection system 105. For example, a device (e.g., a CD player, game counsel, a VHS player, etc.) coupled to the command interface 130 may provide the projection system 105 access to a content brightness map corresponding to content to be projected. In such an example, the content brightness map may be generated by the device or by preprocessing circuitry, such that the content brightness map is generated based on the media stored on the device. At block 705, the controller 120 may determine the content brightness map as a result of determining the intended brightness of one or more frames of content that may be projected. Advantageously, the projection system 105 may use content specific values to determine calibration values. The projection system 105 proceeds to block 715.

At block 715, the controller 120 determines a maximum duty cycle for each color to achieve the target brightness and/or the target color temperature. For example, the controller 120 may determine a maximum duty cycle of a pulse of the LED PWM signal 326 of FIG. 3C in one or more of the color spaces 304-310 to achieve the target color temperature at the target brightness. At block 715, the controller 120 uses the target color temperature and brightness determined in block 420 of FIGS. 4A, 4C, and 6. For example, the controller 120 may limit the duty cycle of a portion of the LED PWM signal 326 in the blue color space 308 as a result of the target color temperature having a higher yellow tint opposed to a blue tint. In such an example, the controller 120 may determine a maximum duty cycle based lower color temperatures having increased yellow tints (such light may be referred to as warm white, warm light, etc.) and higher color temperatures having increase blue tints (such light may be referred to as bright white, daylight, etc.). At block 715, the controller 120 may be configured to use measured content values to determine the target brightness and/or the target color temperature. The measured content values include one or more measurements from the sensors 135-150. Advantageously, the integration complexity of the projection system 105 is reduced as a result of limiting the potential operations of the LED PWM signal 326 during calibration. Advantageously, the power efficiency of the projections system 105 is increased as a result of limiting the current density of the LED PWM signal 326, such that portions of each pulse that would not be used for the target color temperature are not supplied to the illumination source 125 of FIGS. 1 and 2. The projection system 105 proceeds to block 720.

At block 720, the controller 120 determines an LED current. At block 720, the controller 120 may determine an LED current amplitude based on the target brightness, determined at block 625 of FIG. 6 and adjusted at block 650 of FIG. 6. The controller 120 may be configured to increase the current amplitude to reduce to the duration that the illumination source 125 is enabled, such that the duration that the illumination source 125 is enabled is minimized. For example, the controller 120 determines an amplitude of the LED current modulation signal 322 of FIG. 3B and/or the amplitude of the LED PWM signal 326 based on the target brightness, such that a current density of the LED PWM signal 326 corresponds to the target brightness. In such an example, the controller 120 may use a calibration value to determine and/or apply a gain to the amplitude to modify the amplitude to account for a calibration value determined in FIGS. 5 and 6. At block 720, the controller 120 may determine the LED current amplitude based on the target color temperature determined at block 515 of FIG. 5. For example, the controller 120 may increase the amplitude of the pulses of the signals 322 and/or 326 in the color spaces 304 and 306 as the target color temperature decreases and brightness increases. At block 720, the controller 120 may determine the amplitude of the signals 322 and/or 326 based on configuration data at block 725.

At block 725, the controller 120 operations are modified as a result of an LED current setting. The LED current setting at block 725 may be set by the manufacturer to indicate the magnitude of the amplitude modulation performed on the signals 322 and/or 326 to set the LED current to a value which achieves the target color temperature and/or target brightness. Alternatively, the LED current setting at block 725 may limit the amplitude modulation of the signals 322 and/or 326 to achieve values defined in the specification of the projection system 105. Advantageously, the controller 120 may adjust the brightness and/or color temperature of light produced by the illumination source 125 as a result of modifying the amplitude of the signals 322 and/or 326. The projection system 105 proceeds to block 730.

At block 730, the controller 120 determines a PWM sequence. For example, the controller 120 controls the SLM 115 of FIGS. 1 and 2 using the PWM signal 302 of FIGS. 3A-3C. In such an example, the controller 120 configures the SLM 115 to project a specific color as a result of a combination of pulses of one or more duty cycles across the color spaces 304-310. At block 730, the controller may determine the PWM sequence as a result of accessing configuration data at block 735. At block 735, the controller 120 accesses PWM sequence configuration data. For example, the controller 120 may access the PWM sequence configuration data to determine duty cycles for each of the color spaces 304-310 corresponding to one or more colors. At block 730, the controller 120 may modify the PWM sequence configuration data, determined at block 735, to achieve the required R:G:B ratios determined at block 525 of FIG. 5, the target color temperature determined at block 515, and/or the target brightness determined at block 625. For example, the controller 120 may generate a PWM sequence to configure the SLM 115 to increase the duration of time that green light is modulated from the illumination source 125 towards the projection surface 110. In such an example, the controller 120 may increase and/or decrease the duty cycle of the PWM sequence in each of the color spaces 304-310 to increase and/or decrease the contributions of one or more colors. Advantageously, the controller 120 determines the PWM sequence to control the SLM 115 based on the values determined at block 410 and 420, such that the projection system 105 is calibrated for operating conditions of the projection environment 100. The projection system 105 proceeds to block 740.

At block 740, the controller 120 determines an LED PWM sequence. For example, the controller 120 determines a duty cycle of one or more pulses of the LED PWM signal 326 for each of the color spaces 304-310 to modify the color temperature and/or brightness of the illumination source 125. In such an example, the controller 120 limits the brightness of the illumination source 125 as a result of limiting the current density of the LED PWM signal 326, such that the SLM 115 may only produce light contributions less than or equal to the maximum duty cycle determined at block 715 in any given color space. At block 740, the controller may determine the LED PWM as a result of accessing configuration data at block 745. The controller 120 may be configured to determine a duty cycle of the LED PWM signal in each of the color spaces based on a maximum duty cycle, current amplitude, and/or calibration values. For example, the controller 120 may determine a duty cycle for the LED PWM signal in the red color space 304 based on the LED current and the current density required to achieve the target brightness. In such an example, the controller 120 determines a duty cycle which supplies the illumination source 125 with a current density to generate light approximately equal to the target brightness. At block 745, the controller 120 may access configuration data for the LED PWM configuration. For example, the controller 120 may determine the duty cycle of a pulse in the red color space 304 as a result of determining a duty cycle corresponding to the target brightness and/or target color temperature in at block 745. Advantageously, the controller 120 may determine a duty cycle for one or more pulses comprising the LED PWM signal 326 as a result of accessing the configuration data at block 745. The projection system proceeds to block 750.

At block 750, the controller 120 configures the projection system to the LED current, the PWM sequence, and/or the LED PWM. For example, the controller 120 generates the LED PWM signal 326 based on the LED current amplitude determined at block 720 and the duty cycle in each color space determined at block 740. In such an example, the controller 120 generates the PWM signal 302 based on the duty cycles determined at block 730, such that the combination of the duty cycles achieves the required duty cycle determined at block 525. Advantageously, the controller 120 may adjust the operations of the projection system 105 to account for the measured operating conditions of the projection environment 100 as a result of modifying the characteristics of the signals 302, 322, and/or 326. The projection system 105 proceeds to block 755.

At block 755, the controller 120 determines a hue of the projection surface 110. At block 755, the controller 120 may determine the hue of the projection surface 110 as a result of receiving sensor input at block 760. At block 760, the camera 150 captures an image of the projection surface 110 to determine the presence of any hue. For example, the controller 120 may determine the color of the projection surface 110 as a result of receiving the image captured at block 760. At block 755, the controller 120 may represent the hue of the projection surface 110 in terms of a color space. Advantageously, the camera 150 enables the projection system 105 to determine a hue of the projection surface 110 based on the operating conditions of the projection environment 100. The projection system 105 proceeds to block 765.

At block 765, the controller 120 determines a color space. At block 765, the controller 120 determines the color space of the projection system 105 as a result of accessing the configuration data at block 770. At block 770, the controller 120 determines the color space of the projection system 105 in the color configuration data at block 770 based on the operating conditions of the projection environment 100. For example, the controller 120 may determine the color space in the color space configuration data at block 770 based on the target color temperature and/or target brightness, such that the R:G:B ratios which may be generated by the SLM 115 in the operating conditions of the projection system 105 are included in the determined color space. In such an example, the color space configuration may be selected based on calibration values used to determine a range of colors that may be projected by the SLM 115, such that the range of colors are included in the selected color space. At block 765, the controller 120 may modify the color space configuration data from block 770 based on the measured operating conditions. The projection system 105 proceeds to block 775.

At block 775, the controller 120 subtracts the hue from the color space. For example, the controller 120 may subtract a value corresponding to a yellow hue from the color space determined at block 765, such that all of the colors comprising the color space are adjusted to compensate for the hue of the projection surface 110. At block 775, the controller 120 may subtract the hue determined at block 755 from each color comprising the color space of the projection system 105 in the projection environment 100. Advantageously, the projection system 105 adjusts the light being projected to account for a hue of the projection surface 110. The projection system proceeds to block 780.

At block 780, the controller 120 configures the color space. For example, the controller 120 configures the signals 302, 322, and/or 326 to generate colors within the color space determined at block 775, such that the impact of a hue of the projection surface 110 is minimized. Advantageously, the projection system 105 minimizes the impact of a hue of the projection surface 110 as a result of modifying the color space of the projection system 105 to account for the operating conditions of the projection environment 100. For example, the projection system may configure the color space based on a subtraction of the hue of the projection surface from a determined color space. The projection system 105 proceeds to end the calibration process of block 430.

Although example methods are described with reference to the flowchart illustrated in FIG. 7, many other methods of determining and/or setting calibration values for the projection system 105 may alternatively be used in accordance with this description. For example, the order of execution of the blocks may be changed, and/or some of the blocks described may be changed, eliminated, or combined. Similarly, additional operations may be included in the manufacturing process before, in between, or after the blocks shown in the illustrated examples.

In this description, the term "and/or" (when used in a form such as A, B and/or C) refers to any combination or subset of A, B, C, such as: (a) A alone; (b) B alone; (c) C alone; (d) A with B; (e) A with C; (f) B with C; and (g) A with B and with C. Also, as used herein, the phrase "at least one of A or B" (or "at least one of A and B") refers to implementations including any of: (a) at least one A; (b) at least one B; and (c) at least one A and at least one B.

The term "couple" is used throughout the specification. The term may cover connections, communications, or signal paths that enable a functional relationship consistent with this description. For example, if device A provides a signal to control device B to perform an action, in a first example device A is coupled to device B, or in a second example device A is coupled to device B through intervening component C if intervening component C does not substantially alter the functional relationship between device A and device B such that device B is controlled by device A via the control signal provided by device A.

A device that is "configured to" perform a task or function may be configured (e.g., programmed and/or hardwired) at a time of manufacturing by a manufacturer to perform the function and/or may be configurable (or re-configurable) by a user after manufacturing to perform the function and/or other additional or alternative functions. The configuring may be through firmware and/or software programming of the device, through a construction and/or layout of hardware components and interconnections of the device, or a combination thereof.

As used herein, the terms "terminal", "node", "interconnection", "pin" and "lead" are used interchangeably. Unless specifically stated to the contrary, these terms are generally used to mean an interconnection between or a terminus of a device element, a circuit element, an integrated circuit, a device or other electronics or semiconductor component.

A circuit or device that is described herein as including certain components may instead be adapted to be coupled to those components to form the described circuitry or device. For example, a structure described as including one or more semiconductor elements (such as transistors), one or more passive elements (such as resistors, capacitors, and/or inductors), and/or one or more sources (such as voltage and/or current sources) may instead include only the semiconductor elements within a single physical device (e.g., a semiconductor die and/or integrated circuit (IC) package) and may be adapted to be coupled to at least some of the passive elements and/or the sources to form the described structure either at a time of manufacture or after a time of manufacture, for example, by an end-user and/or a third-party.

Circuits described herein are reconfigurable to include the replaced components to provide functionality at least partially similar to functionality available prior to the component replacement. Components shown as resistors, unless otherwise stated, are generally representative of any one or more elements coupled in series and/or parallel to provide an amount of impedance represented by the shown resistor. For example, a resistor or capacitor shown and described herein as a single component may instead be multiple resistors or capacitors, respectively, coupled in parallel between the same nodes. For example, a resistor or capacitor shown and described herein as a single component may instead be multiple resistors or capacitors, respectively, coupled in series between the same two nodes as the single resistor or capacitor.

Uses of the phrase "ground" in the foregoing description include a chassis ground, an Earth ground, a floating ground, a virtual ground, a digital ground, a common ground, and/or any other form of ground connection applicable to, or suitable for, the teachings of this description. Unless otherwise stated, "about," "approximately," or "substantially" preceding a value means+/−10 percent of the stated value.

Modifications are possible in the described embodiments, and other embodiments are possible, within the scope of the claims.

What is claimed is:

1. A controller configured to:

access a content brightness map;

determine an amplitude of a light emitting diode (LED) current based on the content brightness map, a target brightness, or a target color temperature;

determine a pulse width modulation (PWM) sequence based on the content brightness map, the target brightness, or the target color temperature;

determine an LED PWM signal based on the content brightness map, the target brightness, the target color temperature, or the amplitude of the LED current;

transmit a signal indicating the LED current to an LED;

transmit the PWM sequence to a spatial light modulator (SLM); and transmit the LED PWM signal to the LED.

2. The controller of claim 1, further configured to:

determine a red:green:blue (R:G:B) ratio based on receiving an R:G:B value from an RGB sensor;

determine a target R:G:B ratio based on the target color temperature; and determine a red:green:blue:cyan:magenta:yellow:white (R:G:B:C:M:Y:W) ratio of the SLM based on the R:G:B ratio and the target R:G:B ratio.

3. The controller of claim 1, further configured to determine a red:green:blue:cyan:magenta:yellow:white (R:G:B:C:M:Y:W) ratio of the SLM based on the target brightness.

4. The controller of claim 1, further configured to determine the target brightness and the target color temperature based on receiving one or more user inputs.

5. The controller of claim 1, further configured to:

determine ambient light conditions based on receiving an ambient light value from an ambient light sensor;

determine a target contrast based on receiving a user input; and determine the target brightness based on the ambient light conditions and the target contrast.

6. The controller of claim 1, further configured to:

determine an illumination temperature based on receiving a temperature value from a temperature sensor; and determine the target brightness based on the illumination temperature and the LED PWM.

7. The controller of claim 1, further configured to determine an on time of the SLM based on a total of durations during which the SLM has displayed content and determine the target color temperature based on the on time of the SLM.

8. The controller of claim 1, further configured to:

determine a hue of a projection surface based on receiving an image of the projection surface; and modify a color space of the SLM based on a subtraction of the hue from the color space.

9. A projection system comprising:

a controller;

an illumination source coupled to the controller, the illumination source configured to produce illumination light based on a first signal from the controller;

a spatial light modulator (SLM) coupled to the controller and optically coupled to the illumination source, the SLM configured to produce a projected image based receiving a second signal from the controller and based on the illumination light; and sensor circuitry coupled to the controller, the sensor circuit configured to produce a produce a sensor signal based on the projected image, the sensor circuitry comprising an ambient light sensor or an illumination temperature sensor; and wherein the controller is configured to generate calibration values based on a comparison of sensor signal to target values.

10. The projection system of claim 9, wherein the sensor circuitry comprises a red:green:blue (RGB) sensor.

11. The projection system of claim 9, wherein the controller is configured to instruct the illumination source and the SLM to project content based on the projected image and the calibration values.

12. The projection system of claim 9, wherein the controller is further configured to generate a pulse width modulation (PWM) sequence to instruct the SLM to modulate the illumination light.

13. The projection system of claim 9, wherein the controller is further configured to generate a light emitting diode (LED) PWM signal having a maximum duty cycle and an amplitude representing a brightness of the projected image.

14. The projection system of claim 13, further comprising adjusting the maximum duty cycle of the LED PWM signal based on the sensor signal.

15. The projection system of claim 9, wherein the calibration values are configured to instruct the projected image to have values determined based on the projected image, the target values comprising a target brightness, a target color temperature, or a target R:G:B ratio.

16. A method comprising:

determining, by a controller, a first pulse width modulation (PWM) sequence based on a target brightness, a target color temperature, and a target red:green:blue (R:G:B) ratio;

projecting, by a spatial light modulator (SLM), a projected image based on the first PWM sequence;

measuring, by sensor circuitry, content values based on the projected image;

comparing, by the controller, the target brightness to a measured brightness, the target color temperature to a measured color temperature, or the target R:G:B ratio to a measured R:G:B value;

determining, by the controller, calibration values based on the comparison and based on a total time that the SLM has projected content; and determining, by the controller, a second PWM sequence based on the calibration values.

17. The method of claim 16, wherein the method further comprising receiving, by a command interface, user input indicating values of the target brightness, the target color temperature, or the target R:G:B ratio.

18. The method of claim 16, wherein the sensor circuitry comprises a light sensor, a red:green:blue (RGB) sensor, an illumination temperature sensor, or a camera.

19. The method of claim 16, wherein the method further comprises:

determining ambient light conditions based on receiving, by the controller, an ambient light value from an ambient light sensor;

determining, by the controller, a target contrast based on receiving a user input; and determining, by the controller the calibration values based on the ambient light conditions and the target contrast.

20. The method of claim 16, wherein the method further comprises determining, by the controller, the calibration values based on a hue of a surface that the SLM is projecting content on, the hue of the surface.

* * * * *